US006968959B1

(12) United States Patent
Garvin

(10) Patent No.: US 6,968,959 B1
(45) Date of Patent: Nov. 29, 2005

(54) MULTIPLE ADVERTISEMENT HOLDER

(76) Inventor: Kevin Garvin, 1104 Magnolia Ave., Panama City, FL (US) 32401

( * ) Notice: Subject to any disclaimer, the term of this patent is extended or adjusted under 35 U.S.C. 154(b) by 87 days.

(21) Appl. No.: 10/412,773

(22) Filed: Apr. 14, 2003

(51) Int. Cl.[7] ..... A47F 3/14

(52) U.S. Cl. ..... 211/50; 211/88.01; 40/124.2; 40/661; 206/449

(58) Field of Search ..... 211/50, 55, 88.01, 211/128.1, 11; 40/124.2, 654.01, 661; D6/402, D6/629, 630; 206/734, 449, 756, 765, 45.25, 206/741, 745, 740, 735

(56) References Cited

U.S. PATENT DOCUMENTS

| | | | | | |
|---|---|---|---|---|---|
| 1,109,561 | A | * | 9/1914 | Williamson | 108/99 |
| 1,556,514 | A | * | 10/1925 | Feldman | 211/55 |
| 1,713,275 | A | * | 5/1929 | Gibson | 211/88.01 |
| 2,282,872 | A | | 5/1942 | Mayer et al. | |
| D135,871 | S | | 6/1943 | Ferrier | |
| 3,684,102 | A | * | 8/1972 | Colter | 211/88.01 |
| 3,782,558 | A | | 1/1974 | Schael, Jr. | |
| D251,466 | S | * | 4/1979 | Ciminelli | D6/311 |
| D261,902 | S | * | 11/1981 | Oakley | D19/78 |
| D267,383 | S | * | 12/1982 | Liptak et al. | D6/470 |
| 4,460,095 | A | * | 7/1984 | Kessler et al. | 211/69.1 |
| D279,639 | S | | 7/1985 | Kellogg | |
| D279,747 | S | | 7/1985 | Kellogg | |
| D279,748 | S | | 7/1985 | Kellogg | |
| D294,908 | S | | 3/1988 | Childress | |
| D296,174 | S | | 6/1988 | McPartland et al. | |
| D300,894 | S | | 5/1989 | Kellogg | |
| D312,018 | S | | 11/1990 | Giesy | |
| 5,080,315 | A | * | 1/1992 | Tucker-Schafer | 248/441.1 |
| D324,883 | S | | 3/1992 | Demirjian | |
| D334,676 | S | * | 4/1993 | Liptak | D6/476 |
| D337,617 | S | * | 7/1993 | Hall, Jr. | D19/90 |
| D354,646 | S | | 1/1995 | Weinstein | |
| D365,484 | S | | 12/1995 | Trattner, Jr. et al. | |
| D367,987 | S | | 3/1996 | Farrell | |
| D369,711 | S | | 5/1996 | Kenney et al. | |
| D373,698 | S | | 9/1996 | Farrell | |
| 5,595,300 | A | * | 1/1997 | Paik et al. | 206/449 |
| D390,053 | S | | 2/1998 | Waters | |
| D392,143 | S | | 3/1998 | Farrell | |
| 5,803,275 | A | * | 9/1998 | Schweitzer | 211/88.01 |
| 6,070,744 | A | * | 6/2000 | Levinson et al. | 211/50 |
| 6,206,225 | B1 | * | 3/2001 | Fox | 220/501 |
| 6,591,522 | B2 | * | 7/2003 | Doss | 40/122 |
| 6,705,473 | B1 | * | 3/2004 | Schlesinger | 211/50 |

* cited by examiner

*Primary Examiner*—Blair M. Johnson
(74) *Attorney, Agent, or Firm*—Peter Loffler

(57) ABSTRACT

A multiple advertisement holder uses a flat sheet member that has a body member attached thereto. The body member has a first cell for holding multiple advertisement materials of a business as well as a second cell that is located forward of the first cell, the second cell holding a flat sheet of stimulus material that further advertises the business and provides the stimulus to attract the attention of a prospective client so that the client may retrieve the advertising material of the business from the device. A third cell may also be provided adjacent the first cell so that the business can provide advertising materials of different sizes and/or heights to the prospective clients. The sheet member can be attached to a desired surface by providing a surface appropriate mechanism to facilitate such attachment.

12 Claims, 4 Drawing Sheets

MULTIPLE ADVERTISEMENT HOLDER

BACKGROUND OF THE INVENTION

1. Field of the Invention

The present invention relates to a holder for holding multiple types of advertisement materials for display to potential clients.

2. Background of the Prior Art

Advertisement is the lifeblood of any business, especially small businesses. One challenge for the business owner is how to effectively advertise the business while maintaining a reasonable budget for the advertisement. Print media as well as radio and television advertisement can offer a business needed exposure, however, such advertising methods tend to be relatively expensive, especially in light of the fact that for such methods to be very effective, a sustained advertising campaign is needed.

Another effective advertising method that tends to be less expensive than print and electronic media involves the use of signs and billboards of various styles. For example, a business may have its name and/or logo placed on the side of a bus, on the side boards during a hockey game, or on a wall within a stadium during a football game. This gives the business exposure to prospective clients. However, such advertising methods are static in that after the prospective client ceases to see the business advertisement, the client tends to forget the about the business and thus the need to contact the business. Accordingly, such advertising methods are best suited for the strategy of name recognition development as opposed to a direct solicitation of clients. In the long run, name recognition pays dividends, however, a business needs short term results, especially a startup business where cash flow tends to be at a premium.

An effective advertisement strategy is to place some item bearing the business name thereon with the prospective client. For example, a business may hand out some form of novelty items, such as pens, key chains, etc., at a trade show, the novelty items remaining with the prospective client after initial contact with the client. This method works well in some business segments, such as many business to business operations. However, many businesses are not well suited for client development via a trade show.

Dry cleaners, restaurants, and insurance agencies are all examples of businesses that do not look to trade shows for prospective client contact. These types of businesses rely on more traditional methods of placing advertisements, such as a brochure or a business card, into the hands of a prospective client, such that the client has the advertisement for subsequent memory refreshment and hopefully contact with the advertising business. One method of placement of the advertisement into the hands of the prospective client is via direct mail, either stand alone or bundled with other advertisers in a mail packet. While this method is tried and true, it tends to be very expensive relative to the results achieved.

Another method is to place business cards and brochures at strategic areas that may be frequented by prospective clients in order to allow such clients to retrieve the brochure or business card. In such a method, the prospective client has advertisement material from the business, which material may be seen by the client days or even weeks later, reminding the client of the need to contact the business. The challenge with this advertisement method is to grab the attention of the prospective client in the first place so that the client develops the desire to retrieve the advertisement of the business from the display area.

Many prior art devices have been proposed that allow the distribution of advertising materials to a prospective business while providing sufficient stimulus to attract the attention of the client to the presence of the material. Such prior art devices, which work with varying degrees of success, tend to be either relatively complex in design and construction, making such devices relatively expensive to procure and thus less desirable to the potential advertiser, or such prior art devices make it relatively difficult to change the stimulus used to attract the attention of the prospective client to the presence of the business's advertisement material. As many businesses may desire frequently changes to the attraction stimulus in order to stay fresh and to try new advertising approaches, and as many companies in the advertisement business may want to rotate a particular advertising setup through more than one business, such difficulty in stimulus exchange is a negative mark on such systems.

Therefore, there exists a need in the art for a device that allows a business to distribute advertising materials, such as brochures and business cards, to a prospective client at a point of contact where such clients tend to be found, which device overcomes the above stated problems found in the art. Specifically, such a device must be of relatively simple design and construction so that it is not unusually expensive to manufacture and procure. Additionally, such a device must allow for the business to be able to provide a stimulus on the device, which stimulus is designed to grab the attention of the prospective client so that the client takes some of the advertising material. The device must allow for easy and rapid change of such stimulus.

SUMMARY OF THE INVENTION

The multiple advertisement holder of the present invention addresses the aforementioned needs in the art. Specifically, the multiple advertisement holder allows a business to distribute advertising materials, such as brochures and business cards, to a prospective client at a point of contact where such clients tend to be found. The multiple advertisement holder is of relatively simple design and construction making it relatively inexpensive to manufacture and procure. The multiple advertisement holder allows for the business using the device to be able to provide a stimulus on the device, which stimulus is designed to attract the attention of the prospective client to the presence of the advertising materials of the business. The multiple advertisement holder allows easy and rapid change of such stimulus.

The multiple advertisement holder of the present invention is comprised of a flat sheet member that has a front surface and a rear surface. A body member is attached to the front surface of the sheet member such that the body member has a first cell that is adapted to receive multiple units of a first advertisement, such as business cards, therein and a second cell adapted to received a sheet material of stimulus for attracting the attention of a prospective client. The first cell is disposed between the second cell and the sheet member. The body member may also have a third cell located adjacent the first cell, the third cell being different in size relative to the first cell, so that the third cell may receive multiple units of a second advertisement which advertisement is different in size relative to the size of the first advertisement. The first cell has a first base located on a first plane and the third cell has a second base located on a second plane that is parallel and spaced apart relative to the first plane of the first base. A hood may be rotatably attached to the front surface of the sheet member, the hood being articulatable between a closed position wherein the hood covers the first cell, the second cell, and the third cell (if provided), and an open position wherein the hood permits access to the first cell, the second cell, and the third cell. A plurality of openings may be located on the sheet member for attachment of the sheet member to a wall or similar structure. A fin may be attached to the rear surface of the sheet member, the fin allowing placement of the sheet member onto a horizontal surface.

BRIEF DESCRIPTION OF THE DRAWINGS

Similar reference numerals refer to similar parts throughout the several views of the drawings.

DESCRIPTION OF THE PREFERRED EMBODIMENT

Figure 1:
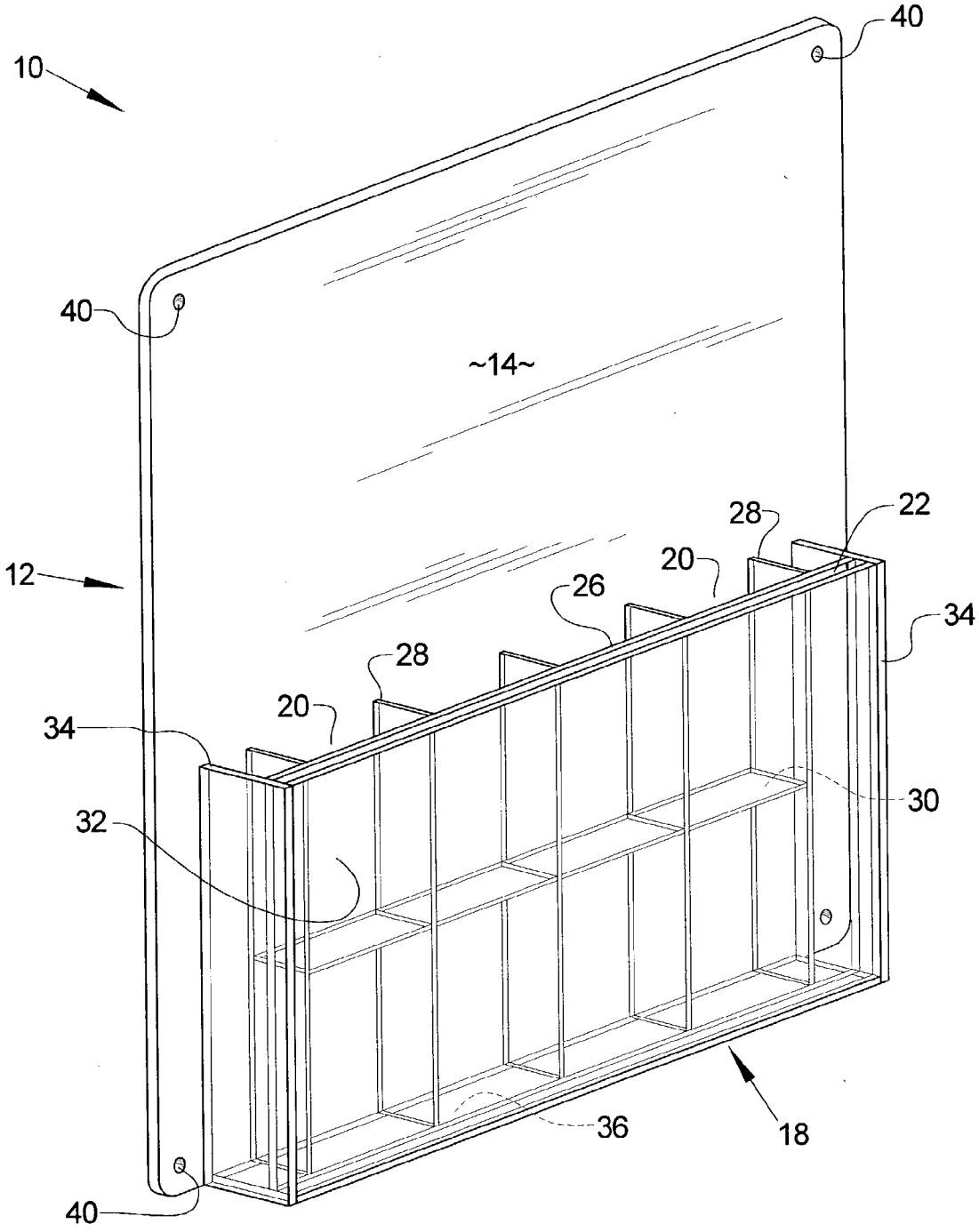
FIG. 1 is a perspective view of the multiple advertisement holder of the present invention.
Figure 2:
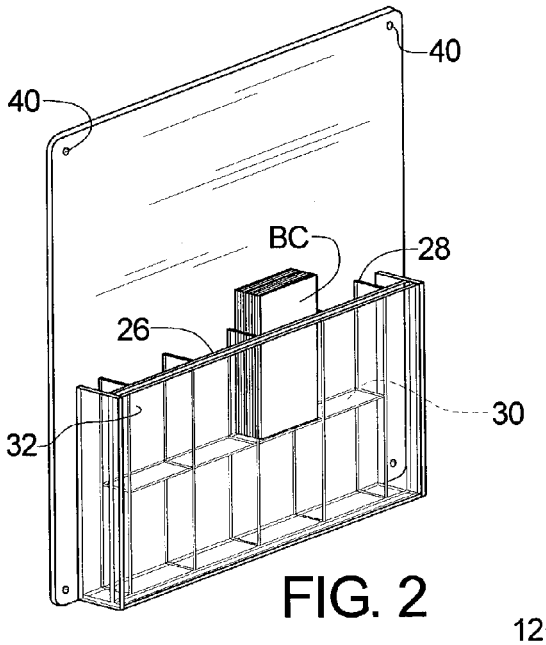
FIG. 2 is a perspective view of the multiple advertisement holder having one type of advertisement held therein.
Figure 3:
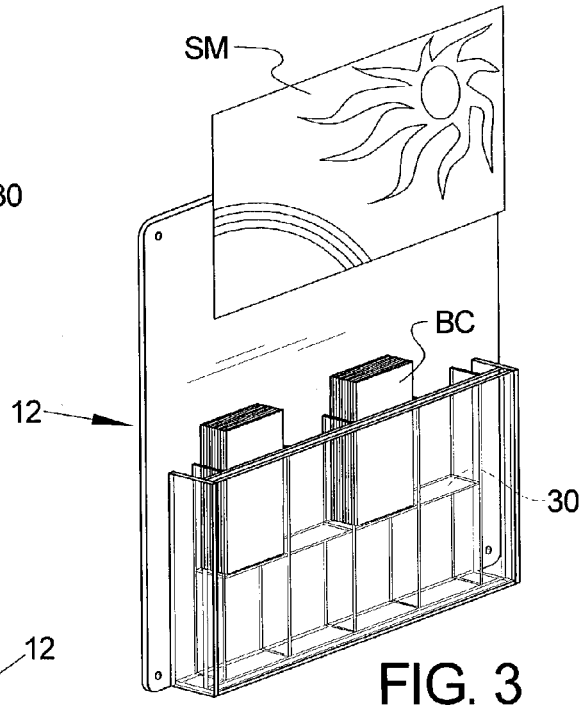
FIG. 3 is a perspective view of the multiple advertisement holder about to receive another type of advertisement therein.
Figure 4:
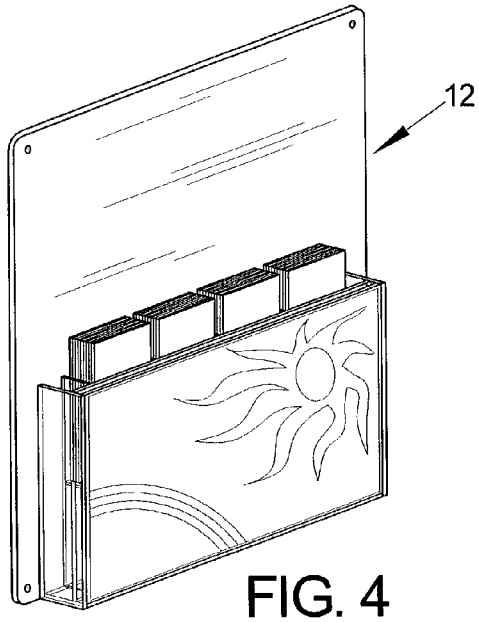
FIG. 4 is a perspective view of the multiple advertisement holder with the second type of advertisement received therein.
Figure 5:
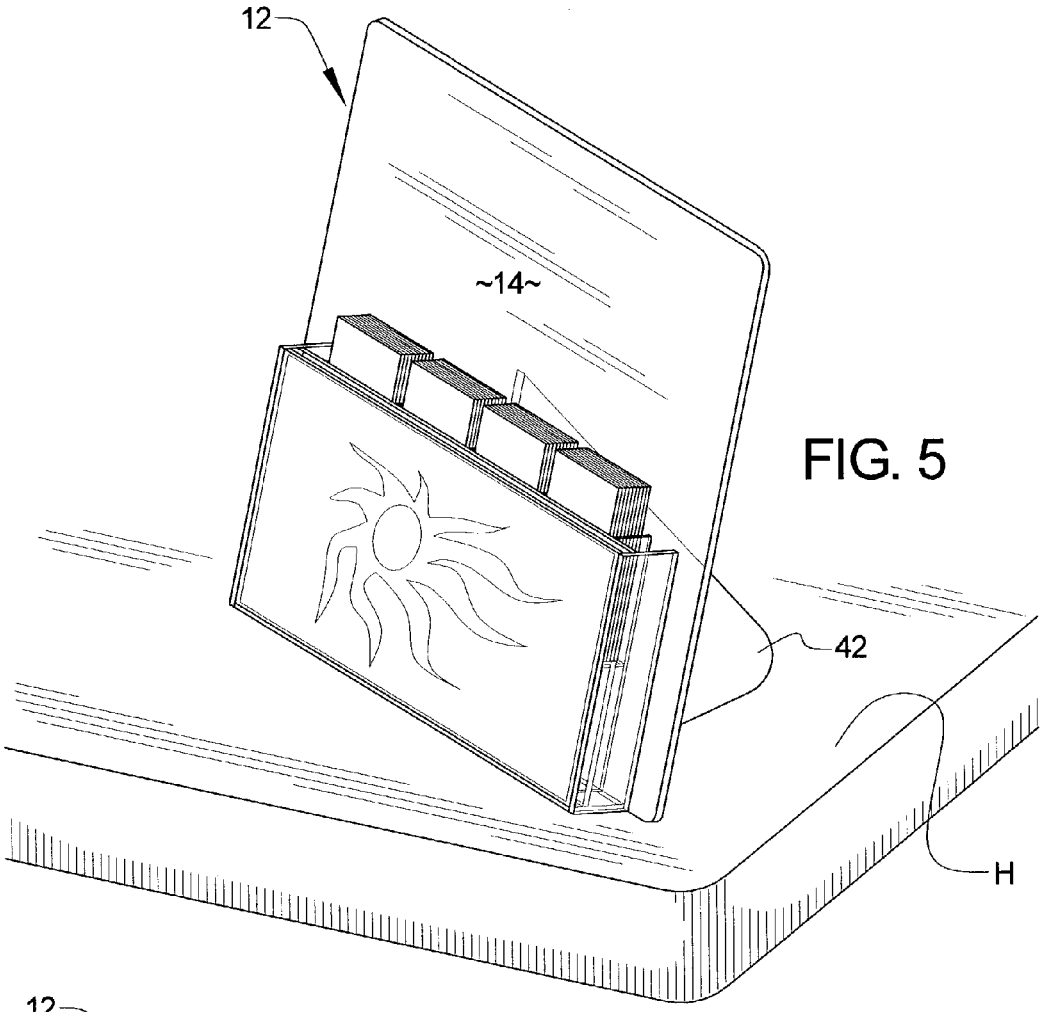
FIG. 5 is a perspective view of the multiple advertisement holder of the present invention utilizing an alternate mounting method.
Figure 6:
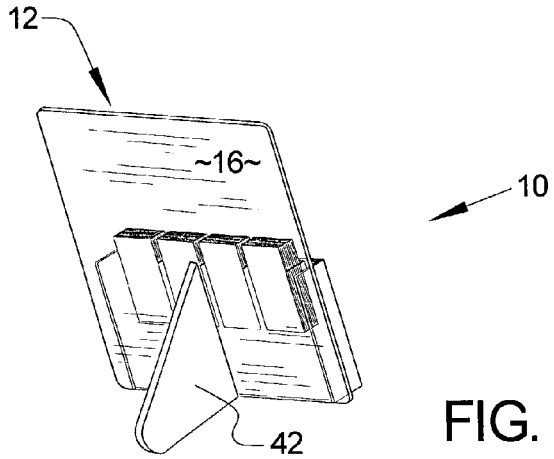
FIG. 6 is a rear perspective view of FIG. 5.
Figure 7:
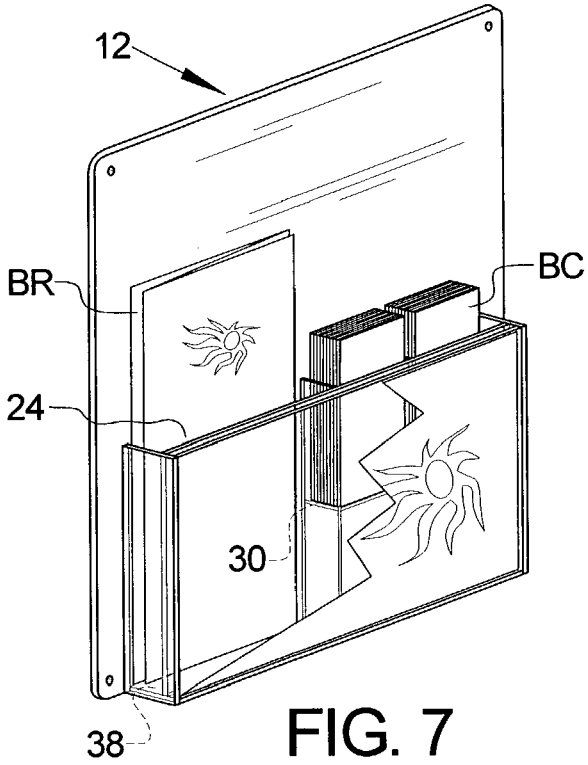
FIG. 7 is a perspective view, partially sectioned, of the multiple advertisement holder of the present invention having more than one cell size.
Figure 8:
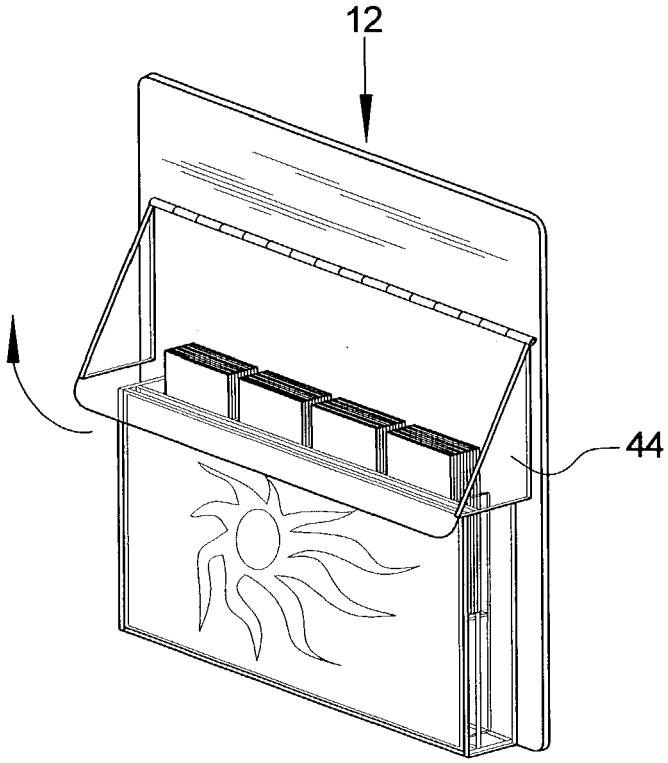
FIG. 8 is a perspective view of the multiple advertisement holder of the present invention having a weather protective hood.

Referring now to the drawings, it is seen that the multiple advertisement holder of the present invention, generally denoted by reference numeral 10, is comprised of a generally flat sheet member 12 that has a front surface 14 and a rear surface 16. A body member 18 is attached to the front surface 14 of the sheet member 12 such that the body member 18 has at least one first cell 20. The at least one first cell 20 receives multiple units of a first advertisement of a business, such as the illustrated business cards BC. The height of each first cell 20 is such that it is at least half of the height of the first advertisement BC being received therein so that when a potential client grabs one of the business cards BC, the remaining cards BC do not easily fall out of the respective first cell. A second cell 22 is provided and receives a sheet material SM of advertising stimulus for attracting the attention of a prospective client. The height of the second cell 22 is such that the sheet material SM fits entirely within this second cell 22. The first cell 20 is disposed between the second cell 22 and the sheet member 12. The body member 18 may also have a third cell 24 that is located adjacent the first cell 20, the third cell 24 being different in size relative (either height or width or both) to the size of the at least one first cell 20, so that the third cell 24 may receive multiple units of a second advertisement, such as the illustrated brochures BR. The height of the third cell 24 is also such that it is at least half of the height of the second advertisement being received therein so that when a potential client grabs one of the brochures BR, the remaining brochures BR do not easily fall out of the third cell 24.

The various cells 20, 22, and 24 are formed by providing a first panel 26 that is attached to the sheet member 12 by a series of generally parallel and vertically disposed first ribs 28 and a horizontally disposed first base 30. The second cell 22 is specifically formed by providing a second panel 32 that is attached to the first panel 26 by providing a series of vertically disposed second ribs 34 that are attached to the first panel 26 and which may also extend to the sheet member 12 as well as providing a horizontally disposed second base 36. The first base 30 and the second base 36 may be joined and may be monolithic is construction. However, as best seen in FIG. 1, the first base 30 may be located above the second base 36, with the second base 36 extending all the way to the sheet member 12. If a third cell 24 is provided, a third base 38 may be provided for attachment of the first panel 26 with the sheet member 12, this third base 38 being parallel to and located below the first base 30. For ease of manufacture, this third base 38 may extend underneath the first base 30, and it is this third base 38 that may be monolithically combined with the second base 36 that forms the second cell 22. The sheet member 12, the first panel 26, the second panel 32, the first ribs 28, the second ribs 34, the first base 30, the second base 36, and the third base 38 are made from any appropriate sturdy material such as plastic or the like and may be attached to each other by any appropriate technique for the particular material such as by adhesion, heat welding, ultrasonic welding, etc. At least the second panel 32 is transparent so that the sheet material SM therein can be seen by a potential client.

The multiple advertisement holder 10 is attached to an appropriate surface by an appropriate technique for the specific attachment. For example, the device 10 may be attached to a wall or similar surface by providing a series of openings 40 at the corners of the sheet member 12, and if needed along the sides and top and bottom of the sheet member 12, wherein appropriate fasteners such as screws (not illustrated) are passed through the openings 40 and into the attachment surface. Alternately, a fin 42 is attached to the back surface 16 of the sheet member 12, either fixedly or capable of collapsing against the rear surface 16 of the sheet member 12, in order to allow the sheet member 12 to rest upon a generally horizontal surface H. Other attachment means are also possible within the scope and spirit of the present invention. Examples of such attachment means, none illustrated, include providing one or more magnets in order the attach the device 10 to a door of a vehicle, the architecture of the magnets accounting for the curvature of the vehicle's door. Alternately, a hook can be provided for hooking the device 10 onto the top surface of a window of the vehicle such that closure of the window jambs the device 10 in place. An appropriately shaped hook can be provided for hooking the device 10 to another member such as to a napkin holder or to an umbrella shaft of a table for restaurant advertising. Other attachment means for the device 10 are also possible within the scope and spirit of the present invention.

Multiple sheet members 12 can be provided and can be attached to each other, either horizontally or vertically, or both, in any appropriate manner known in the art including a tongue and groove attachment, dovetail attachment, etc.

For outdoor usage, a hood 44 is be rotatably attached to the front surface 14 of the sheet member 12, the hood 44 being articulatable between a closed position wherein the hood 44 covers the first cell 20, the second cell 22, and the third cell 24 (if provided), and an open position wherein the hood 44 permits access to the first cell 20, the second cell 22, and the third cell 24. In the closed position, the hood 44 protects the contents of the various cells 20, 22, and 24, from the elements.

In order to use the multiple advertisement holder 10 of the present invention, an appropriate sheet material SM is placed into the second cell 22, while appropriate first advertisements BC are placed into each of the first cells 20, and appropriate second advertisements BR are placed into the third cell 24, if provided. The device 10 is placed into an appropriate location whereat potential clientele may come in contact with the device 10. The sheet material SM within the second cell 22 draws the attention of the potential clients, which clients retrieve the first advertisements BC and second advertisements BR from the device 10 so that the advertisements of the business are before the potential client long after the client has disengaged from contact with the device 10. The advertiser may quickly and easily replace the sheet material SM within the second cell 22 in order to stay fresh and to provide various stimulants in order to attract the attention of potential clients.

While the invention has been particularly shown and described with reference to an embodiment thereof, it will be appreciated by those skilled in the art that various changes in form and detail may be made without departing from the spirit and scope of the invention.

What is claimed is:

1. A holder comprising:

a flat sheet member having a front surface and a rear surface;

a body member, attached to the front surface of the sheet member, the body member having a first cell adapted to receive multiple units of a first advertisement therein and a second cell adapted to received a sheet material of stimulus, the first cell disposed between the second cell and the sheet member;

a third cell located adjacent the first cell, the third cell being different in size relative to the first cell, the third cell adapted to receive multiple units of a second advertisement such that the first cell has a first base located on a first plane and the third cell has a second base located on a second plane that is parallel and in spaced apart orientation relative to the plane of the first base; and a fin attached to the rear surface of the sheet member, the fin allowing placement of the sheet member onto a horizontal surface.

2. The holder as in claim 1 further comprising a hood rotatably attached to the front surface of the sheet member, the hood articulatable between a closed position wherein the hood covers the first cell, the second cell, and the third cell, and an open position wherein the hood permits access to the first cell, the second cell, and the third cell.

3. The holder as in claim 1 further comprising a hood rotatably attached to the front surface of the sheet member, the hood articulatable between a closed position wherein the hood covers the first cell, and the second cell, and an open position wherein the hood permits access to the first cell, the second cell, and the third cell.

4. The holder as in claim 1 further comprising a plurality of openings located on the sheet member.

5. A holder comprising:

a sheet member having a front surface and a rear surface;

a first panel member attached to the front surface of the sheet member by a plurality of vertically disposed first ribs and a horizontally disposed first base member in order to form at least one first cell;

a second panel member attached to the first panel member by a pair of vertically disposed second ribs and a horizontally disposed second base member in order to form a second cell, such that the first cell is disposed between the sheet member and the second cell;

a third base member that is used to attached the first panel member with the front surface of the sheet member, the third base member being parallel with and vertically spaced apart from the first base member and forming a third cell that is different in size relative to the at least one first cell; and a fin attached to the rear surface of the sheet member, the fin allowing placement of the sheet member onto a horizontal surface.

6. The holder as in claim 5 further comprising a hood rotatably attached to the front surface of the sheet member, the hood articulatable between a closed position wherein the hood covers the first cell, the second cell, and the third cell, and an open position wherein the hood permits access to the first cell, the second cell, and the third cell.

7. The holder as in claim 5 further comprising a hood rotatably attached to the front surface of the sheet member, the hood articulatable between a closed position wherein the hood covers the first cell, and the second cell, and an open position wherein the hood permits access to the first cell, the second cell, and the third cell.

8. The holder as in claim 5 further comprising a plurality of openings located on the sheet member.

9. A holder comprising:

a flat sheet member having a front surface and a rear surface;

a body member, attached to the front surface of the sheet member, the body member having a first cell adapted to receive multiple units of a first advertisement therein and a second cell adapted to received a sheet material of stimulus, the first cell disposed between the second cell and the sheet member;

a third cell located adjacent the first cell, the third cell adapted to receive multiple units of a second advertisement such that the first cell has a first base located on a first plane and the third cell has a second base located on a second plane that is parallel and in spaced apart orientation relative to the plane of the first base; and a fin attached to the rear surface of the sheet member, the fin allowing placement of the sheet member onto a horizontal surface.

10. The holder as in claim 9 further comprising a hood rotatably attached to the front surface of the sheet member, the hood articulatable between a closed position wherein the hood covers the first cell, the second cell, and the third cell, and an open position wherein the hood permits access to the first cell, the second cell, and the third cell.

11. The holder as in claim 9 further comprising a hood rotatably attached to the front surface of the sheet member, the hood articulatable between a closed position wherein the hood covers the first cell, and the second cell, and an open position wherein the hood permits access to the first cell, the second cell, and the third cell.

12. The holder as in claim 9 further comprising a plurality of openings located on the sheet member.

* * * * *